US007829830B1

(12) United States Patent
Rogers

(10) Patent No.: US 7,829,830 B1
(45) Date of Patent: Nov. 9, 2010

(54) TECHNIQUES FOR CONTROLLING ACCESS THROUGH A SLOT ON A PROJECTILE

(75) Inventor: Thomas R. Rogers, Simi Valley, CA (US)

(73) Assignee: Woodward HRT, Inc., Santa Clara, CA (US)

( * ) Notice: Subject to any disclaimer, the term of this patent is extended or adjusted under 35 U.S.C. 154(b) by 559 days.

(21) Appl. No.: 11/875,410

(22) Filed: Oct. 19, 2007

(51) Int. Cl.
*F42B 15/01* (2006.01)

(52) U.S. Cl. ..... 244/3.27; 244/3.28

(58) Field of Classification Search ..... 244/3.26, 244/3.24, 3.27, 3.28, 3.29; 89/1.14
See application file for complete search history.

(56) References Cited

U.S. PATENT DOCUMENTS

| | | | | |
|---|---|---|---|---|
| 4,106,727 | A | 8/1978 | Ortell | |
| 4,175,720 | A * | 11/1979 | Craig | 244/3.28 |
| 4,336,914 | A | 6/1982 | Thomson | |
| 4,586,680 | A | 5/1986 | DiTommaso et al. | |
| 4,586,681 | A | 5/1986 | Wedertz et al. | |
| 5,240,203 | A | 8/1993 | Myers | |
| 6,073,880 | A | 6/2000 | Voigt et al. | |
| 6,224,013 | B1 | 5/2001 | Chisolm | |
| 6,446,906 | B1 | 9/2002 | Voigt et al. | |
| 6,695,252 | B1 | 2/2004 | Dryer | |
| 6,761,331 | B2 | 7/2004 | Eisentraut et al. | |
| 6,796,525 | B2 | 9/2004 | Johnsson et al. | |
| 6,880,780 | B1 * | 4/2005 | Perry et al. | 244/3.27 |
| 6,886,775 | B2 | 5/2005 | Johnsson et al. | |
| 6,905,093 | B2 | 6/2005 | Dryer et al. | |
| 6,966,526 | B2 | 11/2005 | Lawless | |
| 7,004,425 | B2 * | 2/2006 | Okada et al. | 244/3.29 |
| 7,083,140 | B1 * | 8/2006 | Dooley | 244/3.27 |
| 7,100,865 | B2 * | 9/2006 | Byrne et al. | 244/3.28 |
| 7,207,518 | B2 * | 4/2007 | Alculumbre et al. | 244/3.29 |
| 2006/0163423 | A1 | 7/2006 | Parine et al. | |
| 2006/0272538 | A1 | 12/2006 | Janik et al. | |
| 2007/0018033 | A1 | 1/2007 | Fanucci et al. | |
| 2007/0138335 | A1 * | 6/2007 | Trouillot | 244/3.28 |

FOREIGN PATENT DOCUMENTS

| | | | |
|---|---|---|---|
| EP | 1321737 | A2 | 6/2003 |
| GB | 2059023 | A | 4/1981 |
| WO | 0179779 | A1 | 10/2001 |

* cited by examiner

*Primary Examiner*—Timothy D Collins
*Assistant Examiner*—Justin Benedik
(74) *Attorney, Agent, or Firm*—BainwoodHuang

(57) ABSTRACT

A slot cover actuation assembly controls access through a slot on a projectile. The slot cover actuation assembly includes a slot cover, a fastener (e.g., a screw), and an actuator (e.g., a squib device). The fastener is arranged to position the slot cover at an installation position on the projectile. The slot cover covers the slot on the projectile when the slot cover resides at the installation position. The actuator is arranged to release the slot cover from the installation position on the projectile. The slot cover uncovers the slot on the projectile when the actuator releases the slot cover from the installation position on the projectile, thus allowing a control surface member (e.g., a fin) to deploy.

15 Claims, 6 Drawing Sheets

TECHNIQUES FOR CONTROLLING ACCESS THROUGH A SLOT ON A PROJECTILE

BACKGROUND

Some conventional guided munitions have movable fins which control their trajectories during flight. The fins, which are located outside the munition shells, move in various directions to steer the guided munitions through air (and/or water) to their intended targets.

For such a conventional guided munition, a guidance system typically resides within the munition shell. The guidance system typically includes a processor, motors, and motor linkages connecting the motors to the fins. During flight, the processor operates the motors which drive their corresponding linkages to move the fins. With the fins disposed on the outside of the munition shell, and the fins aerodynamically guide the munition to its intended targets.

Examples of conventional guided munitions include rockets, guided missiles which are fired from the ground, and guided bombs which are dropped from aircraft. Some conventional torpedoes also have movable fins which enable the torpedoes to change course after launch.

SUMMARY

It may be desirable to store the movable fins of a guided munition within the munition shell until after launch. That is, in some situations, it may be advantageous to initially dispose the movable fins in retracted positions within the munition shell, and later deploy the movable fins into their external operating positions outside the munition shell after launch. For example, with the movable fins in their retracted positions prior to launch, the munition shell may be better suited for certain types of transport and launching alternatives.

One approach to using initially retracted fins involves launching a munition shell from the ground with the fins stored within the munition shell until the munition shell reaches its apex. Then, an unlock/deploy system within the munition shell extends the fins to their external operating positions through openings of the munition shell. Once the fins are in their external operating positions, a guidance system within the munition shell moves the fins thus steering the munition shell to its intended target.

Unfortunately, if the openings of the munition shell through which the fins extend are not initially covered, the guidance system is susceptible to damage. In particular, aerodynamic forces in the vicinity of the openings during launch may wear, overstress or even destroy the motors and/or corresponding linkages of the guidance system. Furthermore, contaminants (e.g., environmental dirt and debris during transport or storage, gases during munition firing, etc.) could enter through the openings and cause the guidance system to operate improperly or even fail. The result may be catastrophic if the guided munition steers off course and hits an unintended target.

Various embodiments of the invention are directed to techniques which control access through slots on projectiles (e.g., guided munitions) using slot covers. While the slot covers are in place, the slot covers are capable of protecting the internal components of the projectiles against external interference (e.g., damaging aerodynamic forces, contamination, tampering, etc.). Once the slot covers are released, control surface members substantially residing within inner cavities are free to extend and control the trajectories of the projectiles.

One embodiment is directed to a slot cover actuation assembly to control access through a slot on a projectile. The slot cover actuation assembly includes a slot cover, a fastener (e.g., a screw), and an actuator (e.g., a squib device). The fastener is arranged to position the slot cover at an installation position on the projectile. The slot cover covers the slot on the projectile when the slot cover resides at the installation position. The actuator is arranged to release the slot cover from the installation position on the projectile. The slot cover uncovers the slot on the projectile when the actuator releases the slot cover from the installation position on the projectile.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Certain embodiments of the invention are directed to techniques which control access through slots (or openings) on projectiles (e.g., a guided munitions) using slot covers. While the slot covers are in place, the slot covers are capable of protecting the projectiles against the passage of external interference (e.g., damaging aerodynamic forces, contamination, external tampering, etc.). Once the slot covers are released, control surface members substantially residing within the outer housings of the projectiles are free to deploy and control the trajectories of the projectiles.

Figure 1:
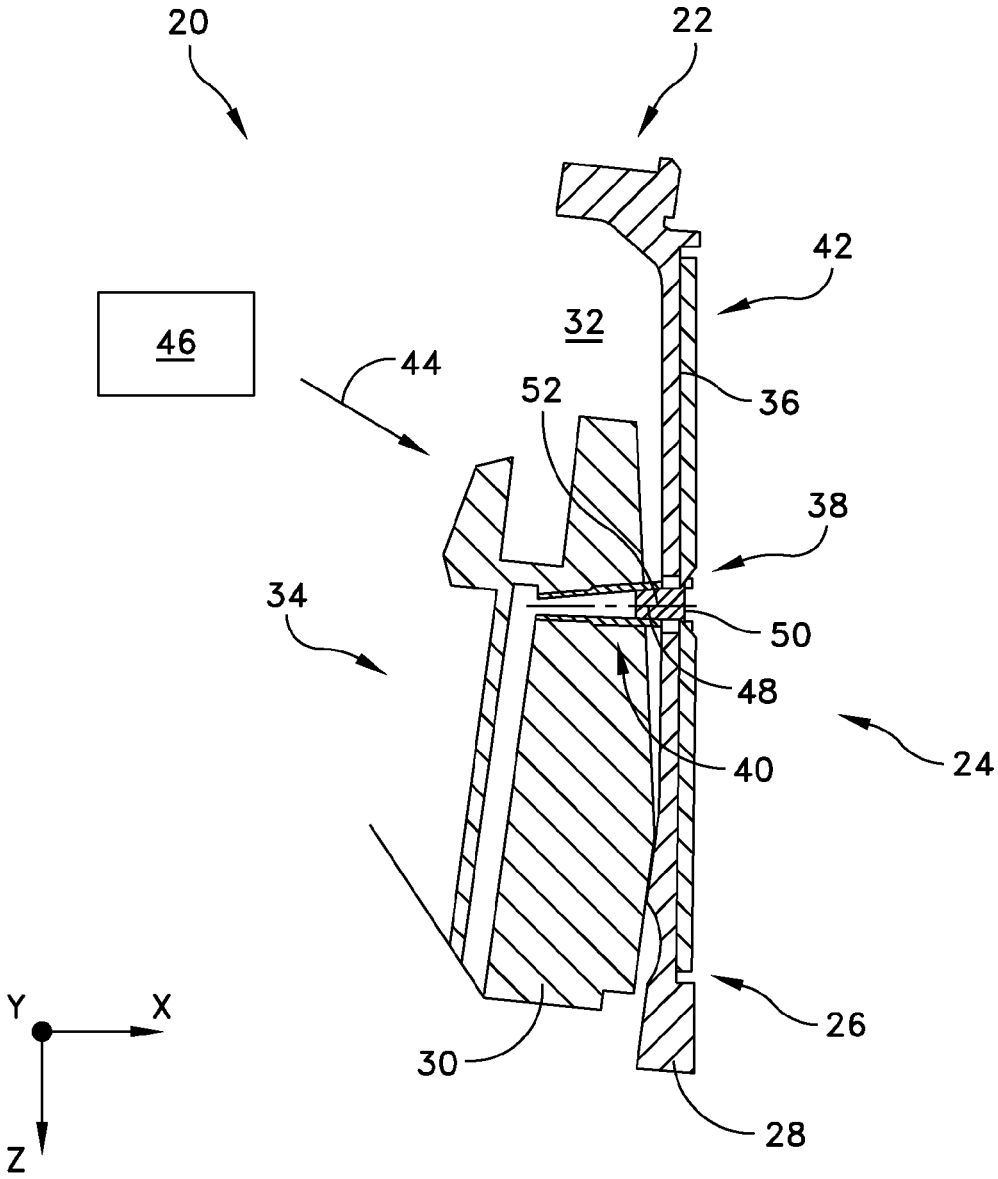
FIG. 1 is a cross-sectional side view of a portion of a projectile apparatus having a slot cover actuation assembly.

FIG. 1 shows a portion of a projectile apparatus 20 (e.g., a guidable projectile) having a projectile body 22 and a slot cover actuation assembly 24. The slot cover actuation assembly 24 is arranged to control access through a slot 26 on the projectile body 22 (i.e., a two dimensional opening in the Y-Z plane of FIG. 1). In particular, while the slot actuation assembly 24 covers the slot 26, the slot actuation assembly 24 inhibits fluid (e.g., air, water, etc.), debris and external objects from passing through the slot 26. However, once the slot actuation assembly 24 uncovers the slot 26, an object such as a movable fin is able to deploy through the slot 26 and then operate to control the direction of the projectile apparatus 20.

As shown in FIG. 1, the projectile body 22 includes an outer housing 28 and an inner support 30. The outer housing 28 defines an inner cavity 32 within which reside the inner support 30 and a set of control surface members 34 (i.e., one or more control surface members 34, illustrated generally by the arrow 34 in FIG. 1). Each control surface member 34 (e.g., a fin, a flap, a wing, a rudder, an aileron, other types of canards, etc.) is capable of passing from the inner cavity 32 through a corresponding slot 26 when that slot 26 is uncovered, and into an operating position which is external to the outer housing 28. Once a control surface member 34 is in such an external operating position, the control surface member 34 is arranged to provide a control surface that influences the trajectory of the projectile apparatus 20 during flight.

The slot cover actuation assembly 24 includes a slot cover 36, a fastener 38, and an actuator 40. The slot cover 36 is substantially plane-shaped (e.g., in the Y-Z plane of FIG. 1) and initially covers a particular slot 26 at an installation position 42 on the projectile body 22. Later, the actuator 40 releases the slot cover 36 from the installation position 42 in response to an activation signal 44, e.g., an electronic signal generated by a guidance system 46 of the projectile apparatus 20.

In some arrangements, the actuator 40 is a squib device having a threaded member 48 that attaches to the inner support 30, and the fastener 38 is a threaded screw (or bolt) having a head portion 50 and shaft portion 52 which threads into the threaded member 48 of the squib device. Prior to detonation of the squib device, the threads of the screw reliably hold the slot cover 36 at the installation position 42. Then, in response to the activation signal 44, the squib device provides an explosive force which propels the slot cover 36 and the fastener 38 in a direction (e.g., see the positive X-direction in FIG. 1) away from the inner support 30 and past the outer housing 28 to remove the slot cover 36 and the fastener 38 from the vicinity of the slot 26.

In some arrangements, threads of the shaft portion 52 are arranged to give way during activation of the squib device thus enabling the screw to release from the threaded member 48 of the actuator 40. For example, the explosive force may be large enough to strip the shaft portion 52 of the screw from its holding position and eject both the screw and the slot cover 36 safely away from the outer housing 28 so that they do not inadvertently interfere with the subsequent flight of the projectile apparatus 20.

In other arrangements, the actuator 40 has an undercut area which is arranged to fail in response to detonation of the squib device. Accordingly, when the squib device explodes, the freed portion of the actuator (e.g., the threaded member 48), the fastener 38 and the slot cover 36 separate from the outer housing 28 allowing the control surface member 34 to freely deploy. Further details will now be provided with reference to FIG. 2.

Figure 2:
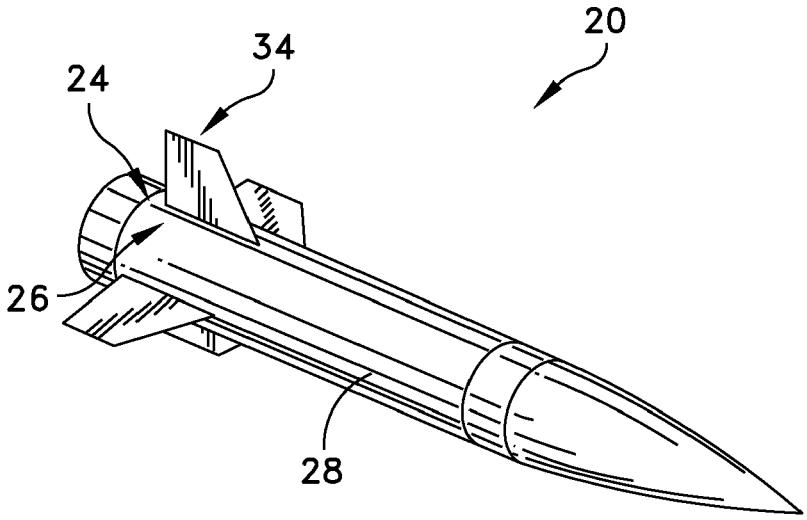
FIG. 2 is a perspective view of the projectile apparatus of FIG. 1.

FIG. 2 is a perspective view of the projectile apparatus 20. Here, the projectile apparatus includes multiple control surface members 34 (e.g., four), each of which is capable of moving in order to control the trajectory of the projectile apparatus 20 while in flight. Of course, more or less than the number shown in FIG. 2 are suitable for use by the projectile apparatus 20 (e.g., two, three, etc.).

It should be understood that, prior to launch, the control surface members 34 reside within the inner cavity 32 (FIG. 1) defined by the outer housing 28. In particular, the projectile apparatus 20 stows the control surface members 34 in retracted states thus enabling certain advantages, e.g., simplified/safer transportation, a broader selection of launching alternatives, less interference from the apparatus 20 if the apparatus 20 is carried beneath an aircraft wing, etc.

However, once the corresponding slot cover actuation assemblies 24 (generally illustrated by the arrow 24 in FIG. 2) of the projectile apparatus 20 release the slot covers 36 and fasteners 38 (also see FIG. 1), the control surface members 34 radially deploy from the inner support 30 (FIG. 1) through the slots 26 as shown in FIG. 2. Such release of the slot covers 36 and fasteners 38, and deployment of the control surface members 34 may occur at a particular time after launch (e.g., at apex of flight, at a particular height relative to sea level, after a predefined amount of time after launch, in response to a transmitted wireless signal, etc.). Further details will now be provided with reference to FIG. 3.

Figure 3:
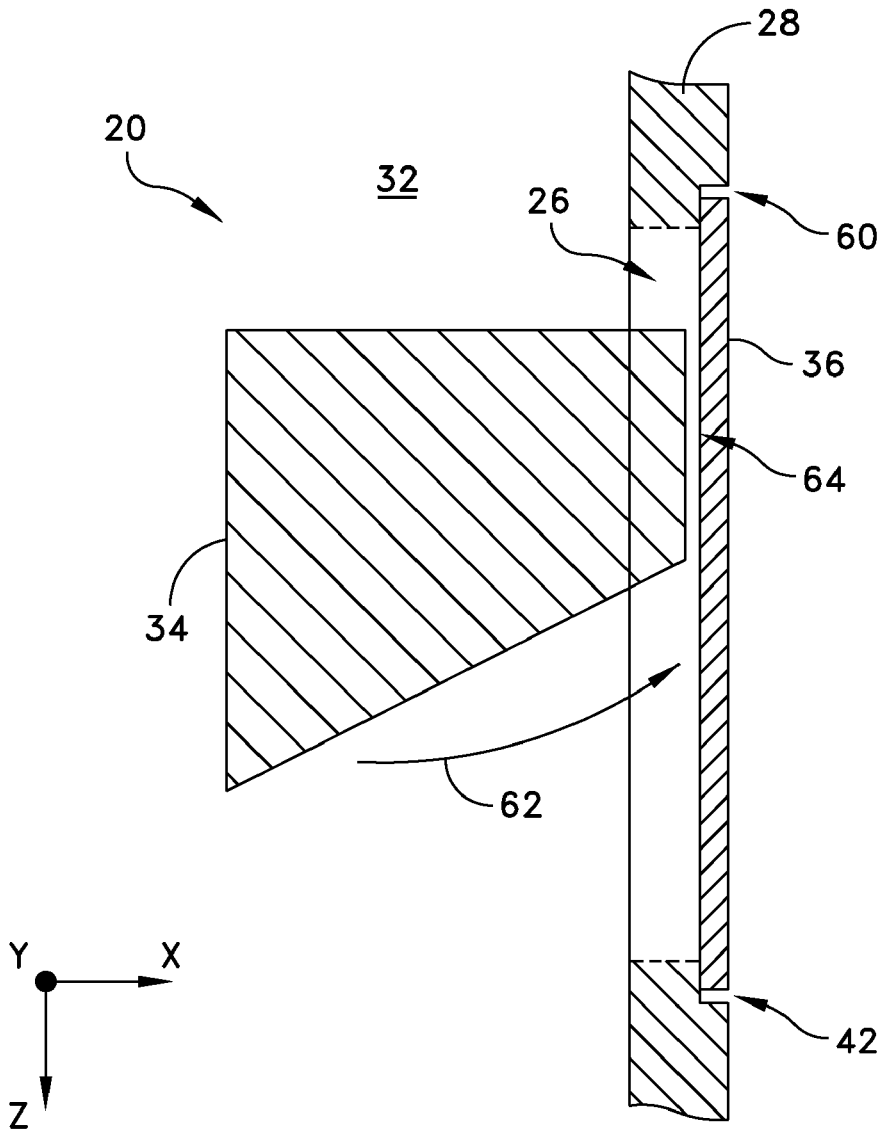
FIG. 3 is a general view of particular components of the projectile apparatus of FIG. 1.

FIG. 3 shows a cross-sectional side view of a portion of the projectile apparatus 20 at a different level than that of FIG. 1 (i.e., through a different point on the Y-axis vis-à-vis FIG. 1). As shown in FIG. 3, a slot cover 36 preferably resides within a recess 60 defined by the outer housing 28. As a result, the top surface of the slot cover 36 is substantially flush with the top surface of the outer housing 28.

As further shown in FIG. 3, a control surface member 34 (e.g., a fin) resides substantially within the inner cavity 32 defined by the outer housing 28, and abuts the slot cover 36 at location 64. In some arrangements, the guidance system 46 (i.e., guidance circuitry, motors, linkages, springs, etc. shown generally by the arrow 46 in FIG. 1) provides a force 62 of a predetermined amount F on the control surface member 34 (e.g., using a spring loaded mechanism) thus urging or biasing the control surface member 34 in a direction from the inner cavity 32 through the slot 26 (e.g., the lower part of the control surface member swings in the X-direction in a counterclockwise manner in FIG. 3). To retain the control surface member 34 within the inner cavity 32 until deployment, the slot cover 36 and the fastener 38 (also see FIG. 1) provide a retention force of at least the predetermined amount F in the opposite direction (i.e., the direction opposite arrow 62) to hold the control surface member 34 substantially within an inner cavity 32. Once the slot cover 36 is removed from the installed position 42, the control surface member 34 automatically deploys through the slot 26 to its external operating position.

In some alternative arrangements, slot cover removal does not serve to release the control surface member 34 (e.g., a spring loaded fin) as described above. In these alternative arrangements, the control surface member 34 is locked in a stowed position perhaps more deeply within the internal cavity 32. Then, once the slot cover 36 is released, the control surface member 34 deploys through the slot 26 into its operating position by actuation of a separate unlocking/deployment system.

By way of example only, the force 62 on the control surface member 34 is shown in FIG. 3 as having a torque component to pivot the control surface member 34 when the control surface member 34 deploys through the slot 26. Other arrangements are suitable for use as well such as lateral deployment, full rotational deployment, etc. Further details will now be provided with reference to FIGS. 4 and 5.

Figure 4:
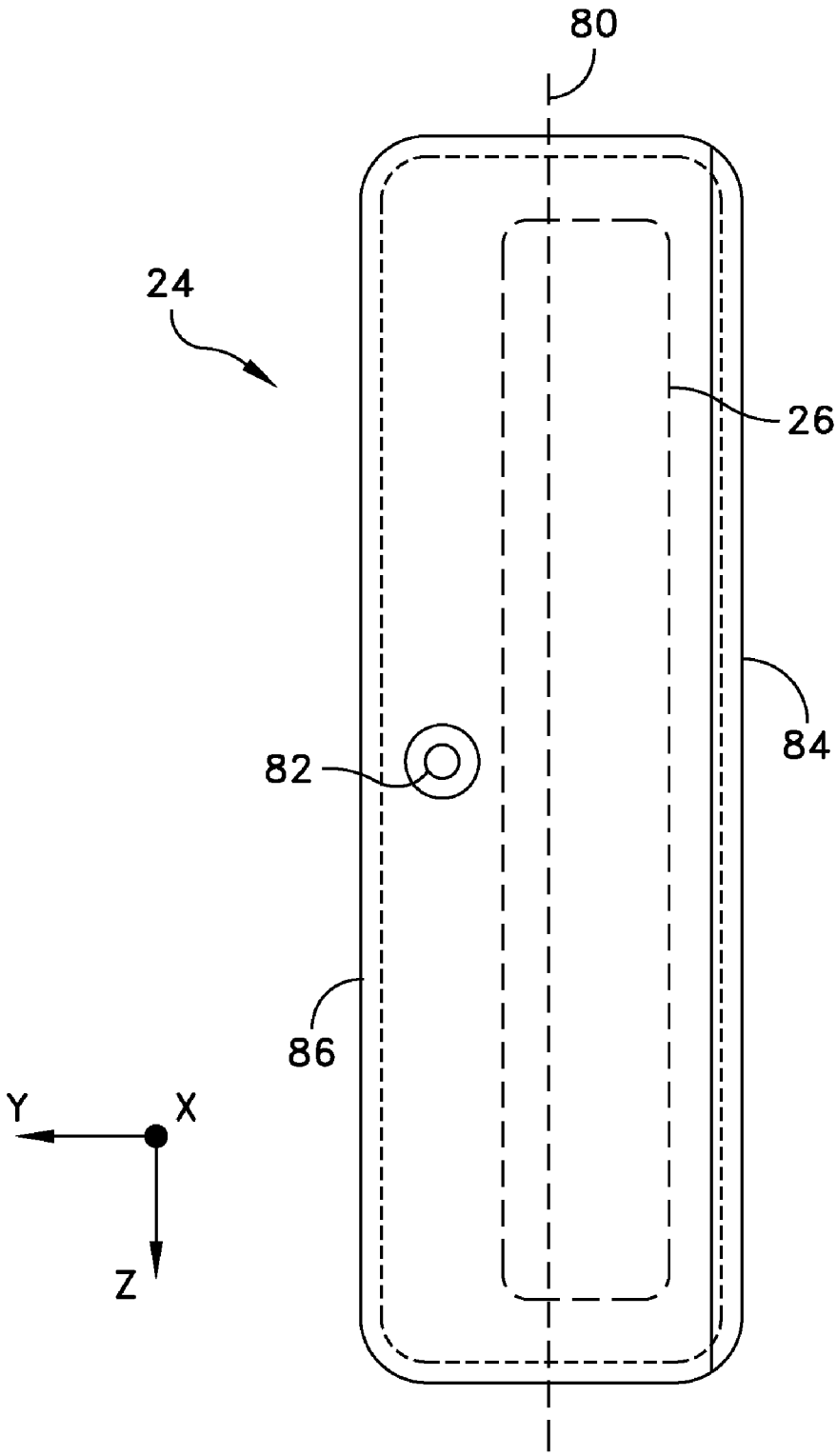
FIG. 4 is a top view of a slot cover of the slot cover actuation assembly of FIG. 1.
Figure 5:
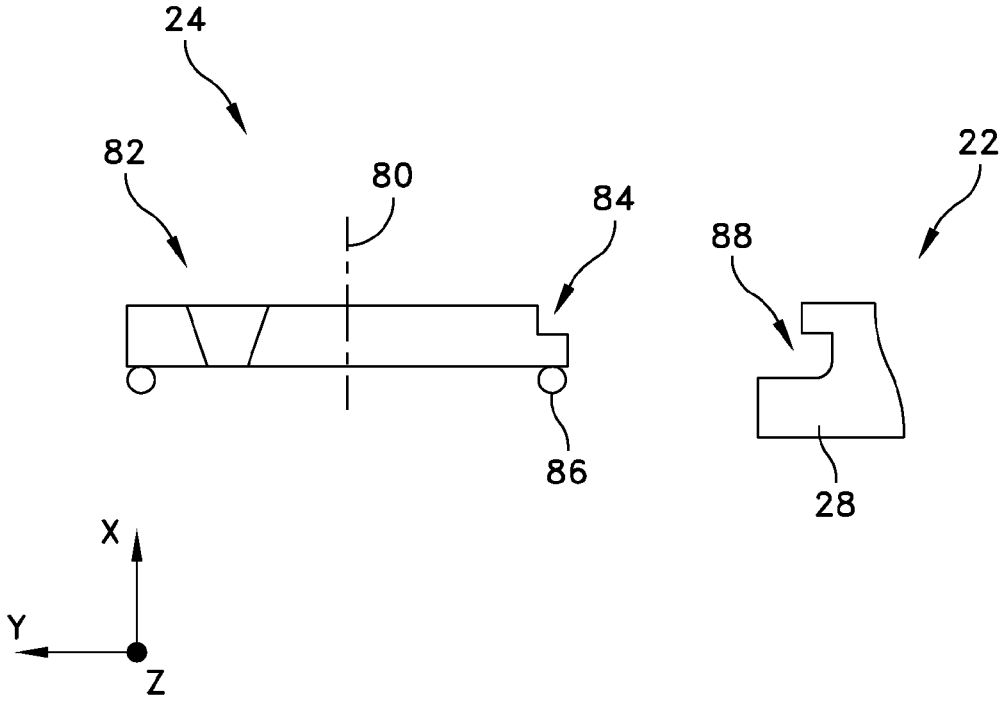
FIG. 5 is a cross-sectional side view of the slot cover of FIG. 4.

FIGS. 4 and 5 illustrate particular details of the slot cover 36. FIG. 4 is a top view of a slot cover 36. FIG. 5 is a cross-sectional side view of the slot cover 36.

As shown, the slot cover 36 is elongated along the Z-direction in FIGS. 4 and 5. The slot cover 36 defines a center axis 80 along the Z-direction, a fastener hole 82, and an elongated hinged lip 84 along the Z-direction, and on the side of the center axis 80 which is opposite the fastener hole 82. For enhanced sealing, a gasket 86 is capable of being positioned substantially around the periphery of the slot cover 84 to provide a compliant seal around the slot 26 (shown by the dashed lines in FIG. 4) between the slot cover 36 and the outer housing 28 of the projectile body 22 when the slot cover 36 resides at the installation position 42 on the projectile body 22 (also see FIG. 1).

The fastener hole 82 (e.g., a countersunk single screw hole) allows the shaft portion 52 (FIG. 1) of the fastener 38 (e.g., an attachment screw) to pass through but provides interference that prevents the head portion 50 from passing through. The fastener hole 82 is offset from the center line 80 thus enabling the fastener 38 to both capture the slot cover 36 and engage the actuator 40 (see the threaded member 48 in FIG. 1) while not blocking the slot 26. The elongated hinged lip 84 is dimensioned to pivotally tuck within a corresponding elongated recess (or groove) 88 of the output housing 28 of the projectile body 22 (FIG. 1) to provide hinged installation onto the outer housing 28 and hinged release of the slot cover 36 from the outer housing 28. That is, both installation and release involves pivoting movement of the slot cover 36 about the Z-axis in FIGS. 4 and 5. Such pivoting of the slot cover 36 about the hinged lip 84 during actuator activation means that there is less actuator load required to unseat and separate the slot cover 36 from the outer housing 28. Further details will now be provided with reference to FIG. 6.

Figure 6:
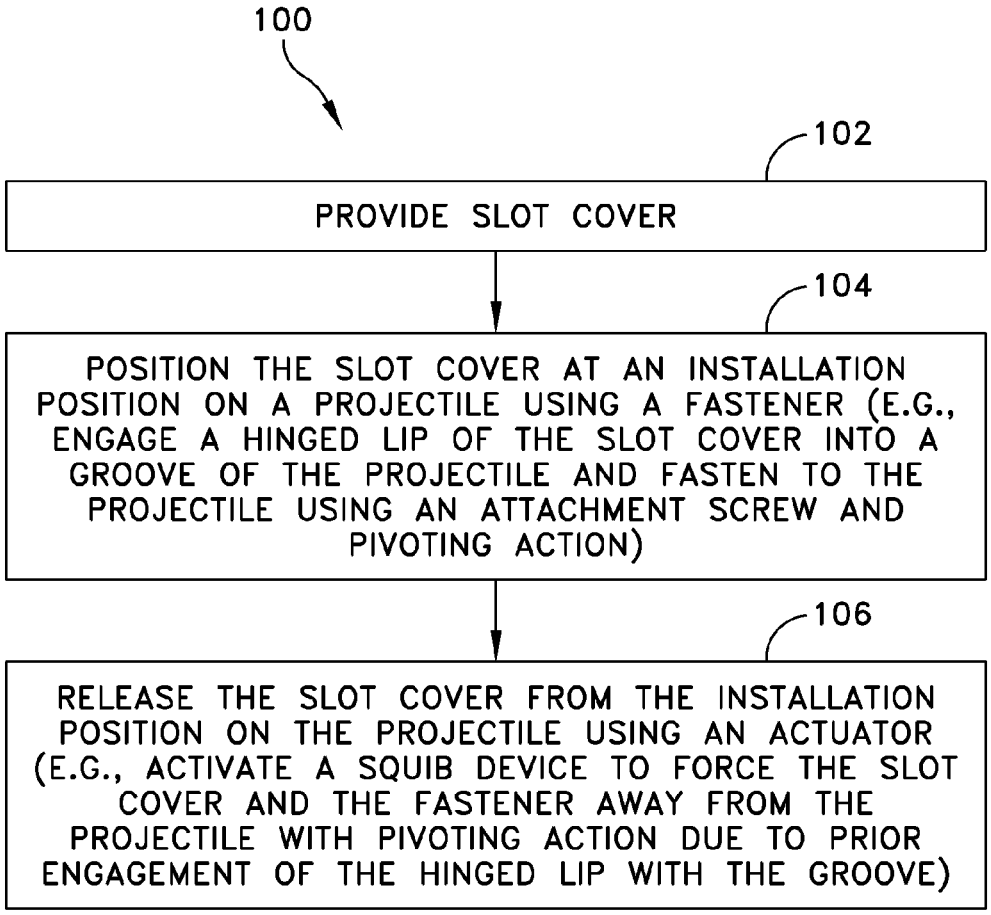
FIG. 6 is a flowchart of a procedure which is performed by a user and/or manufacturer of the projectile apparatus of FIG. 1.

FIG. 6 is a flowchart of a procedure 100 which is performed by a user to control access through a slot on a projectile. In step 102, the user provides a slot cover (e.g., see the slot cover 36 in FIGS. 1 and 3-5).

In step 104, the user positions the slot cover at an installation position on the projectile using a fastener (e.g., see the fastener 38 in FIG. 1). In some arrangements, the user inserts (e.g., engages or tucks) a hinged lip of the slot cover (e.g., see the lip 84 in FIGS. 4 and 5) at an angle (e.g., a 45 degree angle) into a corresponding recess of the projectile (e.g., see the lip 84 and the recess 88 in FIG. 5). The user then closes the slot cover onto the projectile and over the slot by mating a screw with a squib-activated actuator (i.e., the angle of the slot cover flattens out until the slot cover is flat with the surface of the projectile). With the slot cover now residing at the installation position, the slot cover robustly and reliably covers the slot on the projectile (e.g., see FIG. 1).

In step 106, the user arranges for an actuator to release the slot cover from the installation position on the projectile (e.g., see the actuator 40 in FIG. 1). For example, the user configures the squib-activated actuator to release the slot cover in response to an electronic activation signal. Upon receipt of the electronic activation signal, the squib explodes thus releasing the slot cover from the installation position. Such activation is capable of occurring following launch of the projectile while the projectile is in flight. Accordingly, mechanisms within the projectile remain protected against contamination and fluid dynamic stresses through the slot before, during and immediately after launch.

In a situation where there are multiple slots requiring access control, the user is capable of repeating the procedure 100 for each slot. For example, in the context of a projectile having four slots through which initially retracted control surface members 34 deploy following launch, the user performs the procedure 100 for each of the four slots (e.g., see FIG. 2).

As described above, embodiments of the invention are directed to techniques which control access through slots 26 on projectiles 20 (e.g., guided munitions) using slot covers 36. While the slot covers 36 are in place, the slot covers 36 are capable of protecting the internal components of the projectiles 20 against external interference (e.g., damaging aerodynamic forces, contamination, tampering, etc.). Once the slot covers 36 are released, control surface members 34 substantially residing within inner cavities 32 are free to extend and control the trajectories of the projectiles 20.

While various embodiments of the invention have been particularly shown and described, it will be understood by those skilled in the art that various changes in form and details may be made therein without departing from the spirit and scope of the invention as defined by the appended claims.

What is claimed is:

1. A method of controlling access through a slot on a projectile, the method comprising:

providing a slot cover;

using a fastener to position the slot cover at an installation position on the projectile, the slot cover covering the slot on the projectile when the slot cover resides at the installation position; and using an actuator to release the slot cover from the installation position on the projectile, the slot on the projectile being uncovered when the slot cover is released from the installation position on the projectile; wherein the fastener is a screw;

wherein the actuator is a squib device;

wherein using the fastener to position the slot cover at the installation position on the projectile includes pivotally tucking an elongated hinged lip of the slot cover within a corresponding elongated recess of the projectile and threading the screw into the projectile to hold the slot cover at the installation position; and wherein using the actuator to release the slot cover from the installation position on the projectile includes providing an activation signal to the squib device, the squib device being arranged to provide, in response to the activation signal, an explosive force which propels the slot cover and the screw in a direction away from the projectile to remove the slot cover and the fastener from the vicinity of the projectile.

2. A slot cover actuation assembly to control access through a slot on a projectile, the slot cover actuation assembly comprising:

a slot cover;

a fastener arranged to position the slot cover at an installation position on the projectile, the slot cover covering the slot on the projectile when the slot cover resides at the installation position; and an actuator arranged to release the slot cover from the installation position on the projectile, the slot cover uncovering the slot on the projectile when the actuator releases the slot cover from the installation position on the projectile;

wherein the projectile includes an outer housing which defines the slot, and an inner support which is disposed within the outer housing;

wherein the actuator is arranged to attach to the inner support of the projectile; and wherein the actuator includes a squib device which is arranged to provide, in response to an activation signal, an explosive force which propels the slot cover and the fastener in a direction away from the inner support and past the outer housing to remove the slot cover and the fastener from the vicinity of the slot.

3. A slot cover actuation assembly as in claim 2 wherein the actuator further includes a threaded member; and wherein the fastener includes:

exactly one screw which is arranged to thread into the threaded member to position the slot cover at the installation position on the projectile, the threaded screw being arranged to separate from the threaded member in response to the explosive force provided by the squib device.

4. A slot cover actuation assembly as in claim 3 wherein the slot cover is elongated in shape and defines:

a center line which extends in a direction of elongation, and a screw hole through which the screw is capable of passing when positioning the slot cover at the installation position on the projectile, the screw hole being offset from the center line defined by the slot cover.

5. A slot cover actuation assembly as in claim 4 wherein the slot cover further defines:

an elongated hinged lip which extends along an edge in the direction of elongation, the elongated hinged lip being arranged to pivotally tuck within a corresponding elongated recess of the output casing of the projectile to provide hinged installation onto the outer housing and release of the slot cover from the outer housing.

6. A slot cover actuation assembly as in claim 4 wherein the slot cover and the fastener are arranged to provide retention force of at least a predetermined amount in a direction from the installation position toward the inner support to hold a control surface member substantially within an inner cavity defined by the outer housing when the fastener positions the slot cover at the installation position on the projectile.

7. A slot cover actuation assembly as in claim 4, further comprising:

a gasket which substantially extends around a periphery of the slot cover, the gasket being arranged to provide a compliant seal around the slot between the slot cover and the outer housing of the projectile when the slot cover resides at the installation position on the projectile.

8. A slot cover actuation assembly as in claim 4 wherein the screw includes a threaded portion and a head portion; and wherein the slot cover further defines a countersink arranged to recess the head portion of the screw when the threaded portion of the screw engages with into the threaded member of the actuator to position the slot cover at the installation position on the projectile.

9. A projectile apparatus, comprising:

a projectile body; and a slot cover actuation assembly arranged to control access through a slot on a projectile body, the slot cover actuation assembly including:

a slot cover, a fastener arranged to position the slot cover at an installation position on the projectile body, the slot cover covering the slot on the projectile body when the slot cover resides at the installation position, and an actuator arranged to release the slot cover from the installation position on the projectile body, the slot cover uncovering the slot on the projectile body when the actuator releases the slot cover from the installation position on the projectile body;

wherein the projectile body includes an outer housing which defines the slot, and an inner support which is disposed within the outer housing; and wherein the actuator is arranged to attach to the inner support of the projectile body; and wherein the actuator includes a squib device which is arranged to provide, in response to an activation signal, an explosive force which propels the slot cover and the fastener in a direction away from the inner support and past the outer housing to remove the slot cover and the fastener from the vicinity of the slot.

10. A projectile apparatus as in claim 9 wherein the actuator further includes a threaded member which mounts to the inner support; and wherein the fastener includes:

exactly one screw which is arranged to thread into the threaded member to position the slot cover at the installation position on the projectile body, the threaded screw being arranged to separate from the threaded member in response to the explosive force provided by the squib device.

11. A projectile apparatus as in claim 10 wherein the slot cover is elongated in shape and defines:

a center line which extends in a direction of elongation, and a screw hole through which the screw is capable of passing when positioning the slot cover at the installation position on the projectile body, the screw hole being offset from the center line defined by the slot cover.

12. A projectile apparatus as in claim 11 wherein the slot cover further defines:

an elongated hinged lip which extends along an edge in the direction of elongation, the elongated hinged lip being arranged to pivotally tuck within a corresponding elongated recess of the output casing of the projectile body to provide hinged installation onto the outer housing and release of the slot cover from the outer housing.

13. A projectile apparatus as in claim 11 wherein the slot cover and the fastener are arranged to provide retention force at least a predetermined amount in a direction from the installation position toward the inner support to hold a control surface member substantially within an inner cavity defined by the outer housing when the fastener positions the slot cover at the installation position on the projectile body.

14. A projectile apparatus as in claim 11, further comprising:

a gasket which substantially extends around a periphery of the slot cover, the gasket being arranged to provide a compliant seal around the slot between the slot cover and the outer housing of the projectile body when the slot cover resides at the installation position on the projectile body.

15. A projectile apparatus as in claim 11 wherein the screw includes a threaded portion and a head portion; and wherein the slot cover further defines a countersink arranged to recess the head portion of the screw when the threaded portion of the screw engages with into the threaded member of the actuator to position the slot cover at the installation position on the projectile body.

* * * * *

UNITED STATES PATENT AND TRADEMARK OFFICE

CERTIFICATE OF CORRECTION

PATENT NO. : 7,829,830 B1
APPLICATION NO. : 11/875410
DATED : November 9, 2010
INVENTOR(S) : Thomas R. Rogers It is certified that error appears in the above-identified patent and that said Letters Patent is hereby corrected as shown below:

Cover Page, Heading (65), should read: – (65) Prior Publication Data
US 2010-0264254 A1 Oct. 21, 2010

Signed and Sealed this
Twelfth Day of April, 2011

David J. Kappos

David J. Kappos
*Director of the United States Patent and Trademark Office*